United States Patent [19]

Ohtsuka et al.

[11] Patent Number: 4,521,103

[45] Date of Patent: Jun. 4, 1985

[54] ELECTROPHOTOGRAPHIC REVERSAL DEVELOPING APPARATUS WITH CONTROL OF DEVELOPING ELECTRODE BIAS POTENTIAL

[75] Inventors: Shuichi Ohtsuka; Yasuo Aotsuka, both of Kasei; Eiichi Saito, Tokyo, all of Japan

[73] Assignee: Fuji Photo Film Co., Ltd., Japan

[21] Appl. No.: 446,274

[22] Filed: Dec. 2, 1982

[30] Foreign Application Priority Data

Dec. 7, 1981 [JP] Japan ..... 56-196626

[51] Int. Cl.[3] ..... G03G 15/00

[52] U.S. Cl. ..... 355/14 D; 355/3 DD; 118/647

[58] Field of Search ..... 355/14 D, 3 DD, 3 R, 355/10; 430/120–123; 118/656–658, 666, 679, 647

[56] References Cited

U.S. PATENT DOCUMENTS

| | | | |
|---|---|---|---|
| 3,981,268 | 9/1976 | Tsukamoto et al. | 118/647 |
| 4,084,538 | 4/1978 | Tanaka | 118/647 X |
| 4,314,755 | 2/1982 | Kinashi | 355/14 D |
| 4,395,112 | 7/1983 | Miyakawa et al. | 355/14 D |

OTHER PUBLICATIONS

*Electrophotography,* by R. M. Schaffert, Focal Press, 1975, pp. 318–320.

*Primary Examiner*—Richard L. Moses

*Attorney, Agent, or Firm*—Murray, Whisenhunt & Ferguson

[57] ABSTRACT

An electrophotographic reversal-developing apparatus according to this invention comprises first means for determining the temperature and humidity of the surroundings in which an electrophotosensitive material is put; and second means responsive to the so determined temperature and humidity of the surroundings for controlling a biase voltage to be applied to a one-component toner, thereby preventing any fog from appearing in a reversal-developed photographic image.

6 Claims, 12 Drawing Figures

ELECTROPHOTOGRAPHIC REVERSAL DEVELOPING APPARATUS WITH CONTROL OF DEVELOPING ELECTRODE BIAS POTENTIAL

BACKGROUND OF THE INVENTION

1. Field of the Invention

This invention relates to an improvement in or relating to an electrophotographic system in which reversal development is performed according to the magnetic brush developing method using a one-component magnetic toner.

2. Description of the Prior Art

The brush-developing method for obtaining a positive photographic image with a one-component magnetic toner ("positive development") is well known. Specifically, it comprises the steps of charging an electrophotosensitive material with electricity, exposing the material to an image to be reproduced to form a corresponding latent image and applying toner particles to the electric charge-remaining portions (unilluminated parts) of the material in the form of a magnetic brush, as is described, for instance, in Japanese Patent Publication No. 56(1981)-2705.

In contrast to this, in a brush-developing method to obtain a negative photographic image ("negative development"), after forming an electrostatic latent image in an electrophotosensitive material, a one-component magnetic toner is applied to the electric charge-free portions (illuminated parts) of the material in the form of a magnetic brush (the same bias voltage being applied both to the electrophotosensitive material and to an associated developing sleeve). This reversal development is described in Japanese Patent Publication No. 56(1981)-2705 and Japanese Unexamined Patent Publication Nos. 52(1977)-146243, 53(1978)-112740. 53(1978)-115299 and 54(1979)-98248. The present inventor used an electrophotosensitive material consisting of pulverized zinc oxide dispersed in an appropriate binder, and carried out the "reversal development". He found that the reproduced images showed much more fog and worse contrast than positive-developed image.

Japanese Unexamined Patent Publication No. 55(1980)-134864 discloses a magnetic brush reversal developing method and apparatus using a one-component magnetic toner to obtain a reproduced image having no fog and good contrast. In carrying out a "reversal development" in the form of a magnetic brush according to the invention under this patent application, an electrophotosensitive material is charged with electricity to a voltage which is relatively low when compared with its saturation voltage (at which the electrophotosensitive material is charged to its full capacity), for instance to a voltage as low as 60 percent of its saturation voltage (non-saturated voltage), the charging voltage being of the same polarity as the polarity of electric charges on the electrophotosensitive material and of equal or somewhat higher value than the potential at the surface of the material. This reversal developing method enables the formation of a photographic image of the same quality (no fog and good contrast) as a photographic image obtained according to the positive developing method. The disclosed method, however, must use a scorotron, which necessitates two separate power supplies allotted for corona wires and for control grids for controlling the amount of electric charge from the corona wires. Accordingly, the apparatus is expensive and large in size. Still disadvantageously, compared with a corotron, it takes a scorotron much time to raise its charging voltage high enough to assure good development and, therefore, development cannot be expedited. In an attempt to expedite development, there has been proposed the use of a scorotron in combination with a corotron, as described in Japanese Unexamined Patent Publication No. 55(1980)-144260. This, however, is not a complete solution to the problem as mentioned above, and what is worse is that it increases the complexity and size of the apparatus as a whole.

In an attempt to improve the quality of a reversal photographic image obtained according to the magnetic brush reversal developing method to the quality of a positive photographic image obtained according to the magnetic brush positive developing method, the present inventor carried out the following experiments:

There were used a magnetic toner used having an electric resistivity of $10^{10}$ Ω·cm. and a coercivity of 300 oersteds; an electrophotosensitive material consisting a pulverized zinc oxide dispersed in an appropriate binder; and a developing roll comprising 8 magnet pieces each having a strength of 730 gauss and an electric-conductive sleeve enclosure 32 centimeters in diameter. While the sleeve enclosure was kept stationary, the 8-magnet assembly was rotated 1000 times per minute. Two electrophotosensitive sheets were used. One sheet was charged up to saturation voltage with a corotron, whereas the other sheet was charged up to a non-saturation voltage with a scorotron for the purpose of providing a standard of comparison. The charging voltages of these sheets are given in Table 1. After being exposed to an image to be reproduced, the two electrophotosensitive sheets were passed under the developing sleeve at the speed of 7.5 centimeters per second. This experimental revealed that: as regards non-saturation electrostatic charging with the scorotron a fogless photographic image was obtained by applying to the toner on the sheet a bias voltage of substantially the same value as the voltage appearing on the surface of the sheet. As regards saturation electrostatic charging with the corotron a foggy image was obtained when a bias voltage equal to the voltage appearing on the surface of the sheet was applied to the toner attached to the developing sleeve in, for instance, an environment in which the temperature was 17° C. and the humidity was 40%. A fogless photographic image, however, was obtained by applying a much higher bias voltage to the toner on the developing sleeve. The value of bias voltage appropriate for total prevention of fog in the resultant photographic image depends greatly on the temperature, humidity and other environmental factors. In a low-temperature and low-humidity environment, fogless photographic images could not be obtained without applying a voltage to the toner that was very high compared with the surface voltage of the sheet.

In contrast to this, the appropriate bias voltage in case of saturation electrostatic charging with the corotron is substantially independent of the temperature, humidity and other environmental factors.

The results of the experiment are summarized in Table 1.

TABLE 1

| Environment | | Non-saturation electrostatic charging with a scorotron | | Saturation electrostatic charging with a corotron | |
|---|---|---|---|---|---|
| Temperature (°C.) | Humidity (%) | Bias voltage appropriate for preventing fog (V) | Electrostatic charging voltage (V) | Bias voltage appropriate for preventing fog (V) | Electrostatic charging voltage (V) |
| 17 | 40 | −220−−260 | −250 | −700−−1300 | −450 |
| 28 | 70 | −210−−250 | −250 | −400−−600 | −430 |

In respect of the non-saturation electrostatic charging with a scorotron, Table 1 shows that the bias voltage appropriate for preventing the appearance of fog on a photographic image is independent of the surrounding conditions, and is almost equal to the surface potential (electrostatic charging voltage) on the electrophotosensitive sheet, although showing a slight variation. On the other hand in respect of the saturation electrostatic charging with a corotron, which is employed in the present invention, the appropriate bias voltage greatly varies with the surrounding conditions, although the electrostatic charging voltage remains substantially at the same value. Specifically, the appropriate bias voltage changed from −400−−600 volts to −700−−1300 volts when the temperature and humidity of the surroundings changed from 28° C. to 17° C. and from 70% to 40% respectively, while the electrostatic charging voltage change only from −430 volts to −450 volts.

The present inventor carried out another experiment as follows:

An electrophotosensitive material of zinc oxide was put first in a relatively high temperature-and-high humidity environment, and then it was shifted to a relatively low temperature-and-low humidity environment (17° C. and 40%), in which the electrophotosensitive material was subjected, in rapid succession, to electrostatic charging, exposing and developing. The lower limit of the range of appropriate bias voltage fell to about 150 volts below the lower limit of the range of appropriate bias voltage in the case of an electrophotosensitive material kept throughout in low temperature-and-low humidity surroundings (17° C. and 40%).

From these experiments the present inventor was convinced that the characteristics of an electrophotosensitive material vary greatly with the temperature and the humidity of the surroundings, and that the bias voltage appropriate for preventing the appearance of fog in a photographic image is relatively large in a relatively low temperature-and-low humidity environment whereas the appropriate bias voltage is small in a relatively high temperature-and-high humidity environment.

The main cause for dependence of the appropriate bias voltage on the temperature, humidity and other surrounding conditions appears to be the dark decay of the electrophotosensitive material and the rise of the electric resistivity of the conductive support layer of the electrophotosensitve material at a relatively low humidity, thereby causing a potential gradient to appear on the even-charged surface of the material. The present inventor carried out various experiments in which: the length of time from electrostatic charging to developing was varied, and use was made of different electrophotosensitive sheets backed with conductive support layers of resistivity little dependent on the varying surrounding conditions, as for instance metal layer or carbon-dispersed layer. From these experiments the present inventor has concluded that there must be causes for variation in the appropriate bias voltage other than those mentioned above.

As seen from Table 1, an electrophotosensitive material electrostatically charged to its saturation is characterized in that its appropriate bias voltage is much different from the charging voltage, and the relatively wide range over which the appropriate bias voltage can vary is characteristic of an electrophotosensitive material electrostatically charged up to saturation.

SUMMARY OF THE INVENTION

The object of this invention is to provide an improved apparatus for effecting with a one-component toner, magnetic brush development of electrophotosensitive sheet already subjected to electrostatic charging to saturation and to exposure to an image to be reproduced, the developed photographic image being free of fog and good in contrast.

Specifically, in a developing method, with which a developing apparatus according to this invention is associated electrophotosensitive sheets are electrostatically charged to saturation; exposed to an image to be reproduced form a corresponding latent electrostatic image, and finally reverse-developed with a one-component toner in the form of magnetic brush with the toner applied with a bias voltage of the same polarity as the electric charges appearing on the surface of the electrophotosensitive sheet. An improved developing apparatus according to this invention is characterized in that it comprises first means for determining certain conditions of the surroundings in which the latent image bearing electrophotosensitive sheets are put, and for producing a signal corresponding to the surrounding conditions; and second means responsive to the signal from said first means for setting the toner bias voltage at a value appropriate for preventing apperance of fog in electrophotographic images.

As means for providing information on specific environmental conditions there can be used devices which are capable of determining the temperature, humidity or other physical property of the interior environment of the apparatus or of the environment in which the apparatus is used, with the aid of a temperature or humidity sensor; or capable of determining the water content of an electrophotosensitive material with the aid of an appropriate detector; or capable of supplying programmed data according to different seasons of the year.

This invention will be better understood from the following description of preferred embodiments according to this invention made with reference to the accompanying drawings.

DESCRIPTION OF THE PREFERRED EMBODIMENTS

Figure 1A:
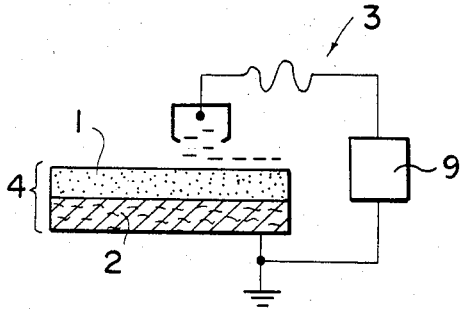
FIG. 1 is a schematic view showing the sequence of steps of the process carried out in an electrophotographic system equipped with a developing apparatus according to this invention.
Figure 1B:
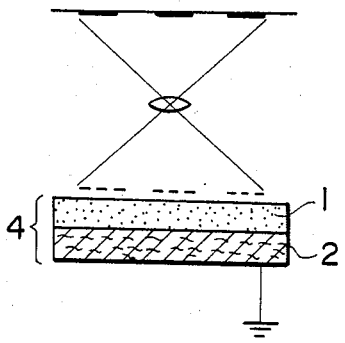
Figure 1C:
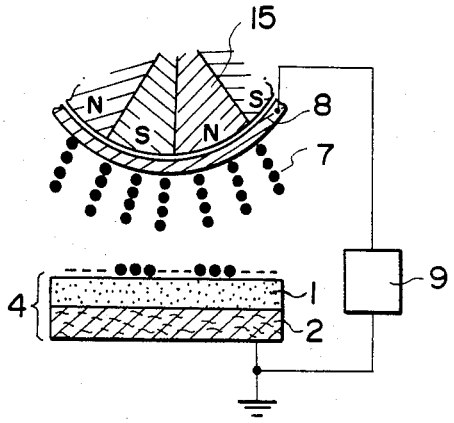
Figure 1D:
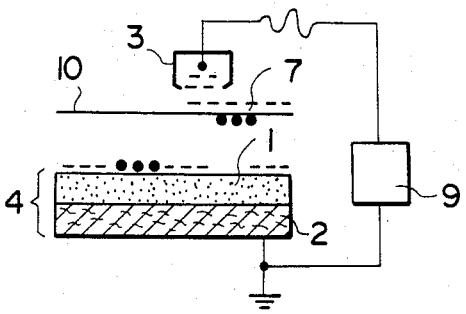
Figure 1E:
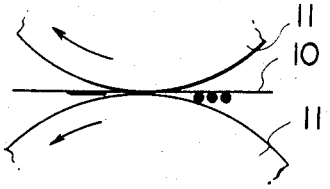

FIG. 1 shows the sequence of steps of the copying and duplicating process which are carried out in an electrophotographic system equipped with a developing apparatus according to this invention. As shown, at the electrostatic charging station (FIG. 1A) an electrophotosensitive sheet 4 is electrostatically charged to saturation with a corona charging apparatus 3. Then, at the exposure station (FIG. 1B) the so charged electrophotosensitive sheet is exposed to an image to be reproduced, thus forming a corresponding latent image on the sheet 4. At the developing obtain (FIG. 1C) an apparatus 9 for detecting certain surrounding conditions and setting accordingly a bias voltage at an appropriate value functions to apply to a developing sleeve 8 a bias voltage appropriate for obtaining a photographic image of good quality irrespective of the surrounding conditions. One-component magnetic toner 7 of relatively great electric resistance and coercive force is magnetically attached to the surface of the developing sleeve by magnets 15, and is brought to be at the same potential as the applied bias potential. The relation between the bias potential of the toner and the charging potential of the electrophotosensitive sheet 4 causes the toner to attach to the charge-dissipated (or illuminated) parts of the sheet 1, thus forming a toner pattern. At the transferring station (FIG. 1D), this toner pattern is transferred to a transfer sheet 10, and finally at the fixing station (FIG. 1E), the so transferred toner pattern is fixed on the transfer sheet 10 with a pressing-and-fixing apparatus (or a heating-and-fixing apparatus) 11. Sometimes, an electrophotosensitive sheet bearing a toner pattern is subjected directly to the fixing process without transferring the toner pattern to a soft sheet. Thus, a hard copy results. In either case a reversal image is reproduced.

Figure 2:
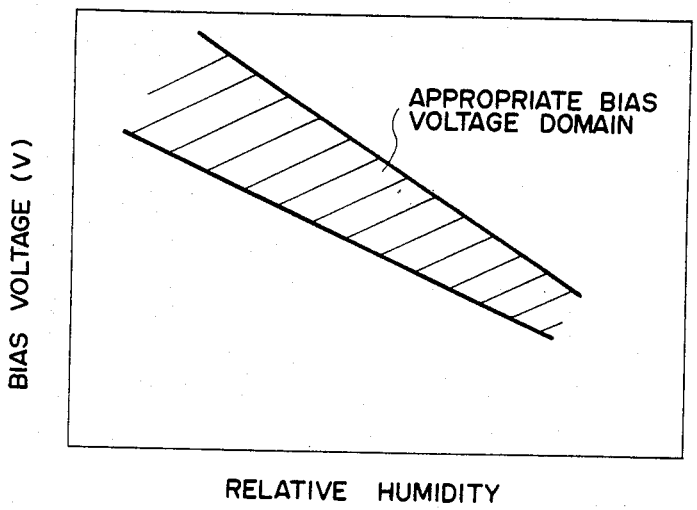
FIG. 2 shows the relationship between relative humidity and bias voltage for an electrophotosensitive material.

In FIG. 2, the graph shows the relationship between bias voltage and relative humidity, which was obtained from the results of the experiment of Table 1. The bias voltage versus relative humidity characteristics are well in conformity with the resistance of paper versus relative humidity characteristics.

According to this invention certain conditions of the surroundings in which the electrophotosensitive sheets are put are determined, and then the bias voltage to be applied to the toner is set at an appropriate value in accordance with the so determined conditions. Alternatively, the bias voltage may be set at an appropriate value manually or automatically according to a predetermined schedule based on the variation in conditions at different seasons of the year.

In the former mode, various sensors may be used to determine the temperature and the humidity of the surroundings in which an electrophotosensitive material is placed; the electric resistance of the paper; the degree of the curl of the paper; the water content of the paper and any other physical properties which vary with the temperature or humidity of the surroundings. Then, an appropriate bais voltage may be determined with reference to the so determined values of these factors.

In the latter mode, the bias voltage may be set manually at an appropriate value determined to be appropriate for the season of the year. Otherwise, a bias voltage may be set at an appropriate value which is selected from among predetermined ones automatically with the aid of a year-cycle timer.

An electrophotosensitive material which is appropriate for use in an electrophotographic system equipped with a developing apparatus according to this invention, consists of pulverized photoconductive material dispersed in or sintered to a binder, and an underlying electrically conductive substrate. As specific examples of photoconductive material there can be mentioned zinc oxide, titanium dioxide, lead oxide and other metal oxides; cadmium sulfide and other metal sulfides; and phthalocyanine and other organic pigments. These materials can be used alone or in combination, and with or without sensitization dye and or other additives. Metal foil or electrosensitized paper or plastic material can be used as a substrate.

Figure 3A:
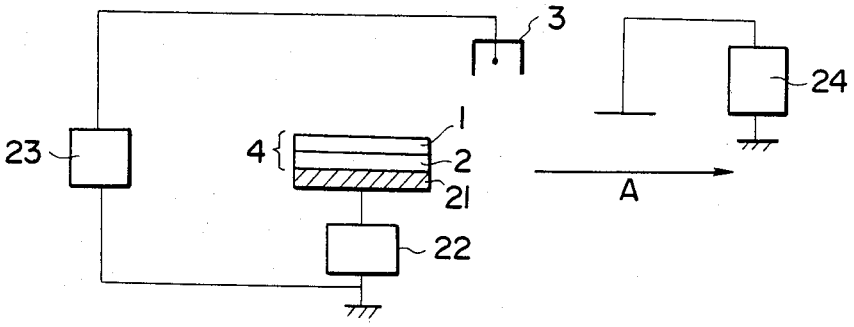
FIG. 3A is a diagrammatic view showing an apparatus for measuring the charging amount and the charging potential of an electrophotosensitive material.
Figure 3B:
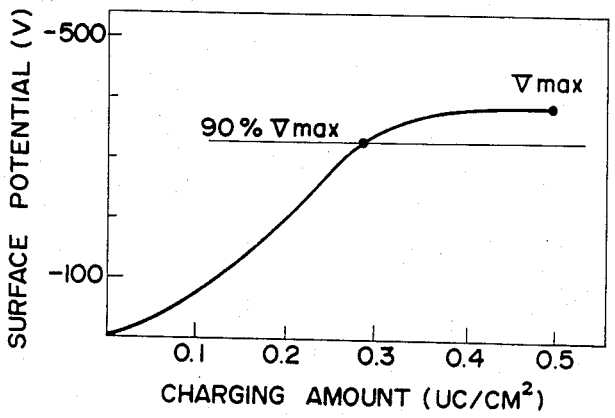
FIG. 3B is a graph representing the relationship between the charging amount and the charging potential on an electrophotosensitive material.

An electrophotosensitive material is electrostatically charged to the extent that it is saturated with electric charges. Specifically it is electrostatically charged until the surface potential has reached as high as 90 percent of the maximum surface potential on the electrophotosensitive material. Electrostatic charging to saturation may be performed as for instance by putting a charging device in the vicinity of the electrophotosensitive material; repeatedly subjecting it to charging process; or applying an increased voltage to a charging device. FIG. 3A shows diagrammatically an apparatus for measuring the amount of electric charges and surface potential on an electrophotosensitive material 4. The electrophotosensitive material 4 is put on a charge measuring apparatus 22 with the conductive substrate 2 of the electrophotosensitive material laid on the electrode 21 of the apparatus 22. The electrode 2 bearing the electrophotosensitive material is moved at a given constant speed in the direction indicated by arrow "A", passing below a corona charging device 3 and stopping at a station 24 at which the surface potential is measured. The amount of electric charges on the electrophotosensitive material 4 is measured by the charge measuring apparatus. The amount of electric charges on the electrophotosensitive material 4 varies with the voltage which a variable power supply 23 applies to a corona wire, and with the distance from the electrophotosensitive material 4 to the corona charging device 3. FIG. 3B shows how the surface potential varies with the amount of the electric charges on an electrophotosensitive material of zinc oxide. Almost all electrophotosensitive materials show the same inclination as seen in FIG. 3B: the surface potential rises with the amount of electric charges until it reaches a constant maximum. Some materials show a slight decrease of surface potential after having reached a maximum value.

The characteristics of the toners appropriate for use in an electrophotographic system equipped with a developing apparatus according to this invention will be described hereinafter in some detail.

In the magnetic brush reversal developing process, the electric resistivity of the one-component magnetic toner has an influence on the density of reproduced images, as shown in Table 2.

TABLE 2

| Resistivity of toner (Ω · cm) | Image reflection density for −300 volts bias voltage | Image reflection density for −800 volts bias voltage |
|---|---|---|
| $2.5 \times 10^6$ | 0.1 | 0.15 |
| $5 \times 10^7$ | 0.3 | 0.6 |
| $3.3 \times 10^9$ | 0.45 | 1.0 |
| $1.7 \times 10^{11}$ | 0.8 | 1.4 |

An 8-pole magnet roll producing a 700 gauss magnetic field, was rotated at a speed of 1000 rotations per minute within an associated stationary sleeve. Zinc oxide electrophotosensitive material, not electrostatically charged, was supplied to the developing device (24.5 $\phi$), the stationary sleeve of which was maintained at a given bias voltage. The electrophotosensitive material of zinc oxide was passed under the developing device at the speed of 7.5 centimeters per second. The results of the experiments are given in Table 2.

As is apparent from Table 2, it is necessary that a toner having an electric resistivity of $10^7$ Ω·cm or more be used to obtain a photographic image of good contrast. It appears to the inventor that: the electrostatic attractive force between the electric potential of the toner 7 and the electric charges on the electrophotosensitive layer 1 is greater than the magnetic attractive force which attracts the toner onto the sleeve 8. Thus, the toner 7 is shifted from the sleeve 8 to the electrophotosensitive layer 1. If the electric resistivity of the toner is relatively small, electric charges of opposite signs exchange between the toner 7 and the electrophotosensitive layer 1 in a relatively short time, and therefore the electrostatic attractive force lowers rapidly with the result that the density of the reproduced image decreases accordingly. Also, it is supposed that the electron exchange between the toner and the electrophotosensitive material is related to the easiness with which electric charges are injected from the toner to the electrophotosensitive material. As for an electrophotosensitive material of zinc oxide, the electron conduction band is at a relatively low energy level (See Photochem. Phobiol., 16, P.219 to P.241, 1972), and therefore minus (negative) electric charges can easily shift from the toner to the zinc oxide layer. The low resistivity of the toner expedites the neutralization of the toner, thus causing deterioration of the quality or contrast of the reproduced image. As regards an electrophotosensitive material of zinc oxide, the cause for lowering of the contrast of a reproduced image is the injection of minus electric charges from the toner to the zinc oxide layer. In case of the toner being maintained at positive potential, for instance the toner being maintained at zero volts and the electrophotosensitive material being maintained at a given minus voltage (positive developing), the low resistivity of toner causes no problem.

Figure 5:
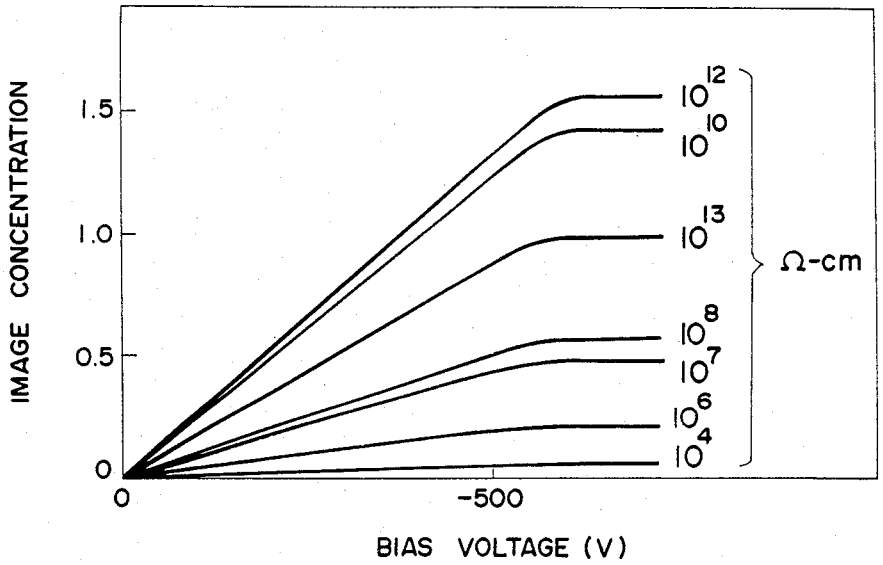
FIG. 5 is a graph showing the relationship between image density and bias voltage for various toners of different electric resistance.

FIG. 5 shows the relationship between image density and bias voltage for different toner resistivities.

As is apparent from the graph of FIG. 5, the image density rises with increasing toner resistivity. The image density, however, decreases for $10^{12}$ Ω·cm or more resistivity, which is supposed to be too great to permit the electric charge-exchange between the toner and the electrophotosensitive material. On developing, the magnetic toner 7 is attracted to the magnet 10, and is attached onto the developing sleeve 8 in the form of chains. If a toner having a resistivity of $10^{12}$ Ω·cm or more is used, the effect of the bias voltage applied to the developing sleeve 8 is not sufficient to bring toner particles 7 most remote from the sleeve 8 to a potential as high as the sleeve, and accordingly the attractive electrostatic force between the toner 7 and the electrophotosensitive layer 1 lowers, with the result that the contrast of the reproduced image lowers.

The toner resistivity was determined according to the method as described in U.S. Pat. No. 3,639,245. The toner resistivity can be controlled by adjusting the amount of carbon, which is added to the toner for the purpose of making the toner electrically conductive.

The coercive force "Hc" of the toner and the magnetic characteristics of the developing sleeve are related to the appearance of fog in reproduced images, as is seen from Table 3.

TABLE 3

| Strength of magnetic field of magnetic roll (gauss) | Coercive force of toner (oersted) | Bias voltage range appropriate for preventing appearance of fog (volts) |
|---|---|---|
| 700 | 300 | −700~−1200 |
| 700 | 230 | −900~−1200 |
| 700 | 150 | −950 |
| 550 | 300 | −900~−1000 |

Two 8-pole magnetic rolls (24.5 $\phi$) capable of generating 700 and 550 gauss magnetic fields respectively were used. The electrophotosensitive material used was of zinc oxide pulverized and dispersed in a resin binder, as was the case with the experiment of Table 2.

As seen from Table 3, when the coercive force of the toner was 150 or more oersteds and when the strength of the magnetic field on the surface of the developing sleeve was 700 gauss, no fog appeared in the photographic images. The cause for appearance of fog in reproduced images is unknown, but is appears that if a slight potential difference appears between the toner 7 and a part of the electrophotosensitive material which corresponding to the white part of the image to be reproduced, a corresponding slight attractive electrostatic force due to the slight potential difference attracts toner 7 to undesirable parts of the electrophotosensitive material. If the coercive force of the toner is 150 or more oersteds, a relatively large attractive magnetic force attracts toner 7 back to the developing sleeve 8 against the counter electrostatic force, thereby preventing fog in the reproduced images.

The coercive force of a toner can be increased to a desired strength by mixing spherical magnetite (about 100 oersteds), needle-shaped magnetite (about 300 oersteds) and cobalt-doped magnetite (about 800 to 1200 oersteds) at a proper ratio. A conventional magnetic toner of as high coercive force as required can be used in a developing apparatus according to this invention.

Figure 6:
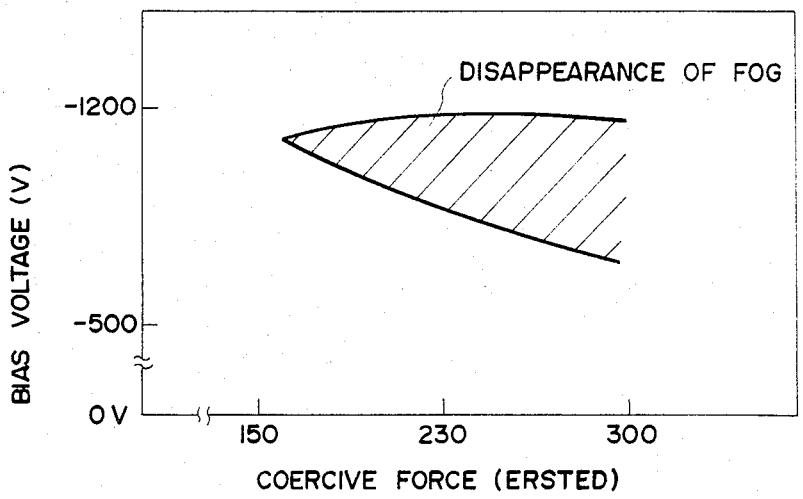
FIG. 6 is a graph with bias voltage represented on the vertical axis and coercive force represented on the horizontal axis, showing a fog-free domain therein.

FIG. 6 shows a fog-free domain in a bias voltage versus coercive force graph.

As seen from the graph of FIG. 6, for a coercive force of 230 or more oersteds, no fog appears even if the bias voltage varies over a relatively wide range because of external causes.

As is understood from the above, a magnetic brush reversal developing apparatus according to this invention using a one-component toner assures that reversal photographic images of good contrast and having no fog are obtained.

Figure 4A:
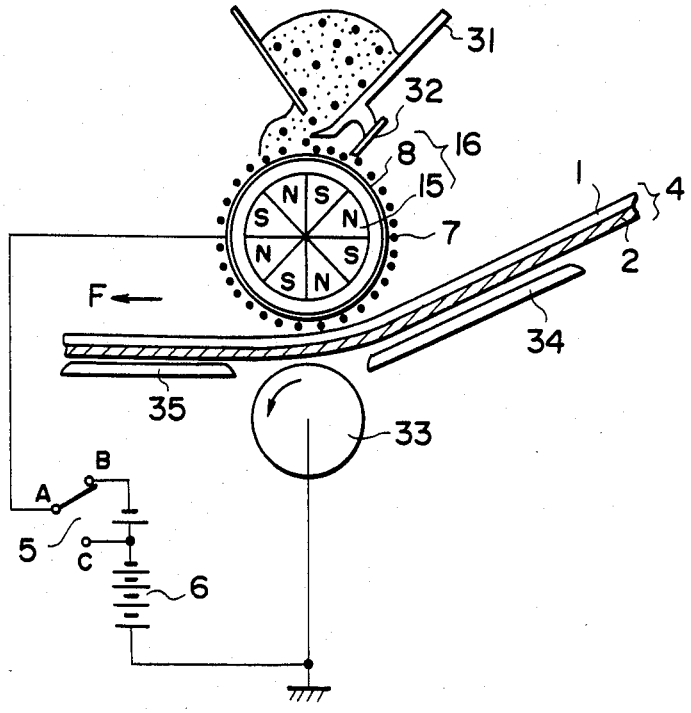
FIG. 4A shows, in section, an electrophotograph developing apparatus according to a first embodiment of this invention.

FIG. 4A shows an electrophotograph developing apparatus according to a first embodiment of this invention. An electrophotosensitive sheet 4 consists of a photosensitive layer 1 backed with an electrically conductive-processed paper 2. The photosensitive layer 1 is of zinc oxide pulverized and dispersed in a resin binder.

The photosensitive layer 1 is 12 microns thick, and is designed to be electrostatically charged to saturation with a corotron, the maximum charging voltage ranging from −450 to −480 volts.

The toner has a resistivity of $5\times10^9$ Ω·cm in an electric field of 4000 volts are centimeter, and a coercive force of 230 oersteds. The particles size ranges from 10 to 25 microns, and the bulk density is 0.98. At the developing station 16 an 8-pole magnetic roll 15 is rotated counterclockwise at the speed of 1000 rotations per minute within a stationary conductor sleeve 8, thus producing a magnetic field as strong as 700 gauss. The toner 7 is contained in a hopper 31, and is continuously supplied onto the stationary sleeve 8. A doctor blade 32 is put about 0.4 millimeters apart from the stationary sleeve, thereby controlling the amount of the supplied toner. The photosensitive material 4 is supplied at the speed of about 7 centimeters per second in the direction "F". A back-up roll 33 is rotated at such a speed that its circumferential speed is equal to about 7 centimeters per second. The photosensitive material 4 travells along guide plates 34 and 34, and the photosensitive material 4 is inclined 20 to 30 degrees at the developing station. After being electrostatically charged to saturation and exposed to the image to be reproduced, the photosensitive material 4 passes through the developing station, and then a bias voltage is applied to the sleeve 8 by connecting a d.c. power supply 6 with the sleeve 8 via an associated switch 5. The switch 5 has one movable contact "A" and two stationary contacts "B" and "C". When the movable contact "A" is brought in contact with the stationary contact "B", a bias voltage as high as −900 volts is applied to the stationary sleeve 8, and when the movable contact "A" is brought in contact with the stationary contact "C", a bias voltage as high as −600 volts is applied to the sleeve 8. The positive terminal of the d.c. power supply 6 is grounded, and at the same time, is connected to the back-up roll 33.

In carrying out a reversal developing method according to this invention a bias voltage is varied with the temperature and humidity of the surroundings so as to prevent the appearance of fog in the photographic images. For instance in Japan, the temperature and humidity of the atmosphere is relatively high in summer, at which time a bias voltage of −600 volts is applied to the sleeve 8 by putting the movable contact "A" in contact with the stationary contact "C" of the switch 5. In winter the temperature and humidity are relatively low, and a bias voltage as high as −900 volts is applied to the sleeve 8 by putting the movable contact "A" in contact with the stationary contact "B" of the switch 5. In this particulars embodiment of FIG. 4A, a two-step switch is used, but the switch and associated d.c. power supply may be constructed so as to control the bias voltage in as many steps as desired to attain fine adjustment.

With this arrangement an operator can select and set the bias voltage at the most appropriate value according to the season of the year, thereby obtaining fog-free reversal images at all times throughout the year.

Figure 4B:
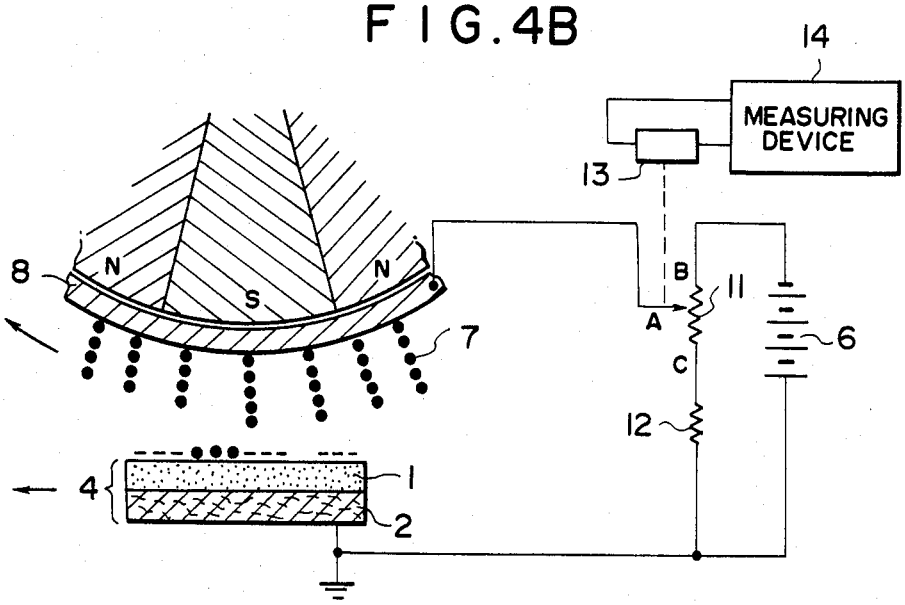
FIG. 4B shows, in section, an electrophotograph developing apparatus according to a second embodiment of this invention.

FIG. 4B shows a developing apparatus according to a second embodiment of this invention. As shown, the minus terminal of a d.c. power supply 6 is connected to one end "B" of a variable resistor 11, and the other end of the variable resistor is connected to the plus terminal of the d.c. power supply 6 through a fixed resistor 12 and to a paper substrate 2 of an electrophotosensitive sheet 4. The plus terminal of the d.c. power supply is grounded, too. The d.c. power supply 6 generates an electromotive force as high as 900 volts. The resistance ratio of the resistor 11 (from "B" to "C") to the resistor 12 is set 2 to 1, and the voltage appearing between the movable contact "A" and ground varies continuously from −600 volts to −900 volts when the movable contact "A" is moved along the full length of the resistor 11 from one end "C" to the other "B". The voltage appearing at the movable contact "A" of the variable resistor 11 is applied to the developing sleeve 8 as a bias voltage. Thus, the toner 7 magnetically attracted to the sleeve 8 is brought to the same voltage as the bias voltage.

An apparatus 14 for measuring the electric resistance of the surface of the paper, which varies with the temperature and humidity of the surroundings, is used to generate a control signal.

An associated servo motor 13 is responsive to the control signal for driving and putting the movable contact "A" of the variable resistor at such a position that the voltage appearing between the movable contact "A" of the variable resistor 11 and ground is at an appropriate value, and the bias voltage thus set is applied to the developing sleeve, and hence the toner is magnetically attracted thereto. Specifically, when the measuring device 14 measures a temperature as high as 28° C. and a humidity as high as 70% in terms of the electric resistance of the paper surface, the variable resistor 11 is designed so as to put its movable contact "A" at such a position that the potentiometer applies a −600 volt bias voltage to the developing sleeve 8. When the measuring device 14 detects a temperature as low as 17° C. and a humidity as low as 40%, the potentiometer applies a −900 volt bias voltage to the developing sleeve 8. Between these upper and lower limits the bias voltage rises continuously with decreasing environmental temperature and humidity and the bias voltage decreases continuously with increasing environmental temperature and humidity. In this particular embodiment electrophotosensitive material 4, toner 7 and developing sleeve 8 are the same as used in the first embodiment described above with reference to FIG. 4A. As seen from the above, the second embodiment is different from the first embodiment in that: in the second embodiment the surrounding conditions are automatically detected, and the bias voltage to be applied to the toner is automatically and continuously controlled to be brought to a value which is appropriate for preventing the appearance of fog in photographic images when developed in the environment, whereas in the first embodiment the bias voltage is manually controlled to be brought to an appropriate value according to the season of the year. The cause for appearance of fog in photographic images is the change in the characteristics of the electrophotosensitive materials due to the surrounding conditions. But, it is difficult to detect any change in the characteristics of the electrophotosensitive material, and therefore the second embodiment measures the electric resistance of the paper, which is fairly close to the characteristics of the electrophotosensitive material.

As is apparent from the above, an electrophotographic system equipped with a developing apparatus according to this invention will produce reversal photographic images free of fog and of good contrast, without need to use an expensive scorotron.

We claim:

1. An electrophotographic apparatus for producing and developing an electrostatic latent image on an electrophotosensitive material, comprising charging means for applying an electrostatic saturation charging voltage of predetermined polarity to an electrophotosensitive material to produce an electrostatically charged and electrophotosensitive material;

means for exposing said electrostatically charged electrophotosensitive material to an image to be reproduced to form a corresponding electrostatic latent image thereon; and developing means for developing said electrostatic latent image to a reversal electrophotographic image, said developing means comprising:

supply means for supplying a one-component magnetic toner;

bias means for applying a bias voltage of the same polarity as said electrostatic saturation charging voltage to said one-component magnetic toner, said bias voltage and said electrostatically charged electrophotosensitive material having a predetermined differential;

magnetic brush means for applying said one-component magnetic toner to said electrophotosensitive material having said electrostatic latent image thereon;

means for determining the environmental conditions in which said electrophotosensitive material is placed and supplying a signal representing the so determined environmental conditions; and control means, responsive to said signal, for changing the voltage differential between said bias voltage and said electrostatically charged electrophotosensitive material by setting said bias voltage to a value appropriate for preventing appearance of fog in a reversal electrophotographic image and assuring good contrast therein.

2. An electrophotographic apparatus according to claim 1 wherein said means for determining the environmental conditions includes means for determining the temperature of the surroundings and means for determining the humidity of the surroundings.

3. An electrophotographic apparatus according to claim 2 wherein said means for determining the environmental conditions and for supplying a signal representing the so determined environmental conditions consists of a switching device manually operable according to the seasons of the year, thereby connecting a selected tap of a d.c. power supply to a toner bearing surface at a developing station.

4. An electrophotographic apparatus according to claim 1 wherein said means for setting the bias voltage at an appropriate value includes a potentiometer equipped with a sliding contact, which is connected to a toner bearing surface at a developing station, and means responsive to the signal representing the environmental conditions for driving the sliding contact on an associated resistor until the potential at the sliding contact reaches the appropriate value.

5. An electrophotographic apparatus according to claim 1 wherein said electrophotosensitive material includes a photosensitive layer of a photoconductor pulverized and dispersed in a binder.

6. An electrophotographic apparatus according to claim 1 wherein said electrophotosensitive material includes a photosensitive layer of zinc oxide pulverized and dispersed in a binder.

* * * * *

UNITED STATES PATENT AND TRADEMARK OFFICE

CERTIFICATE OF CORRECTION

PATENT NO. : 4,521,103

DATED : June 4, 1985

INVENTOR(S) : Shuichi Ohtsuka et al.

It is certified that error appears in the above-identified patent and that said Letters Patent is hereby corrected as shown below:

In the heading of the patent, [73] Assignee:, delete "Fuji Photo Film Co., Ltd., Japan" and insert therefor -- Fuji Photo Film Co., Ltd. and Hitachi Metals, Ltd., Tokyo, Japan. part interest--.

Signed and Sealed this

*Fifth* Day of *November 1985*

[SEAL]

*Attest:*

DONALD J. QUIGG

*Attesting Officer*

*Commissioner of Patents and Trademarks*